US005328055A

United States Patent [19]

Battle

[11] Patent Number: 5,328,055

[45] Date of Patent: Jul. 12, 1994

[54] REFILLABLE LIQUID DISPENSER WITH DIAMOND-SHAPED INNER PLIANT BLADDER

[76] Inventor: John R. Battle, 11306 W. Pool Ct., Crystal River, Citrus County, Fla. 32629

[21] Appl. No.: 982,449

[22] Filed: Nov. 27, 1992

[51] Int. Cl.[5] ..... B67D 5/00

[52] U.S. Cl. ..... 222/83.5; 222/91; 222/94; 222/105; 222/325

[58] Field of Search ..... 222/80, 81, 82, 83, 222/83.5, 88, 91, 92, 94, 105, 325, 340, 416

[56] References Cited

U.S. PATENT DOCUMENTS

| | | | |
|---|---|---|---|
| 3,655,096 | 4/1972 | Easter | 222/82 |
| 3,995,773 | 12/1976 | Schmit | 222/91 |
| 4,098,434 | 7/1978 | Uhlig | 222/105 X |
| 4,163,509 | 8/1979 | Amneus | 222/105 X |
| 4,168,032 | 9/1979 | Sneider | 222/105 X |
| 4,602,725 | 7/1986 | Malpas et al. | 222/83.5 |
| 4,759,473 | 7/1988 | Derby et al. | 222/105 |
| 4,869,398 | 9/1989 | Colvin et al. | 222/83 |
| 5,031,798 | 7/1991 | Wild | 222/82 |
| 5,114,004 | 5/1992 | Isono et al. | 222/94 X |
| 5,143,294 | 9/1992 | Lintvedt | 222/105 X |

*Primary Examiner*—Andres Kashnikow
*Assistant Examiner*—Joseph A. Kaufman
*Attorney, Agent, or Firm*—A. W. Fisher, III

[57] ABSTRACT

A refillable liquid dispenser or container comprising an outer rigid hollow housing including an upper neck having an opening formed therein to receive a liquid dispensing assembly therein and a replaceable inner pliant liquid bladder including an upper portion disposed within the upper neck and a lower portion disposed within the outer rigid hollow housing to receive the lower portion of the liquid dispensing assembly therein.

24 Claims, 5 Drawing Sheets

REFILLABLE LIQUID DISPENSER WITH DIAMOND-SHAPED INNER PLIANT BLADDER

BACKGROUND OF THE INVENTION

1. Field of the Invention

A refillable liquid dispenser or container comprising an outer rigid hollow housing and a replaceable inner pliant liquid bladder.

2. Description of the Prior Art

Numerous spraying devices and liquid containers have been developed. The receptacles are generally formed as a closed container filled with the liquid to be sprayed through a fill opening formed in a neck with a spray head screwed onto the neck.

Unfortunately refilling of such spraying devices and liquid containers commonly has several disadvantages. For example, there is the risk of spilling or overfilling of the liquid during the filling or refilling operation.

U.S. Pat. No. 5,143,294 describes a container for a liquid paint or insecticide product from which the liquid can be applied by a conventional liquid spray device. The container is sealed except for an opening at or near one end having a conventional spray device attached thereto. The dip tube or siphon tube from the spray device is inserted through the opening and sealed by means of a plug through which the dip or siphon tube is inserted. The container with the liquid is then placed into the liquid holding canister. The spray device is then operated to dispense the liquid through the spray nozzle.

U.S. Pat. No. 5,118,003 shows a disposable cover and bag assembly comprising an outer cover member adapted to be connected to the open end of an outer canister and having a top including an opening, an inner cover member in the opening in the top of the outer cover member and a bag having a mouth gripped between the inner and outer cover members.

U.S. Pat. No. 5,056,685 and U.S. Pat. No. 5,031,798 teach a spraying device comprising a receptacle for the fluid to be sprayed and a spray head disposed on the receptacle to dispense or spray the fluid. The receptacle comprises a refill pouch for receiving the fluid and a holding means for detachably holding the refill pouch. The spray head is mounted on the holding means and connected to the interior of the refill pouch through a connection means.

U.S. Pat. No. 4,168,032 describes an expandable syringe comprising a bag having an opening through which liquid may pass. A closed end tubular valve stem projects outwardly from the bag opening and has an orifice in the side thereof in fluid communication with the interior of the bag. A nozzle has a female coupler sized to be movably mounted about the valve stem. The nozzle coupler has a valve seat against which the valve stem closed end may operationally engage in controlling the flow of liquid between the bag and nozzle.

U.S. Pat. No. 3,411,503 shows a syringe for medical use comprising a bellows-type collapsible body containing a diluent and disposed in a case on which a hypodermic needle may be mounted in communication with the body to puncture an enclosing membrane.

U.S. Pat. No. Re. 24,918 discloses a pliant container for containing and dispensing low boiling liquids therefrom.

U.S. Pat. No. 3,203,484 teaches a portable fire extinguishing device utilizing a pliant container from which foam is discharged by means of winding the container upon itself for mixing and dispensing the foam therefrom.

U.S. Pat. No. 3,255,972 shows a pliable container for use with a sprayer generally of the type adapted to be connected to a hose for watering lawns or flowers or the like. In particular, the sprayer has a chemical to be mixed with water contained in a disposable collapsible container or cartridge having an aspiring tube extending into the water stream and further containing means for applying the stream of water pressure to the outer surfaces of the collapsible container to force the liquid chemical through the aspiring tube into the water stream. This device requires the normally rigid container of the spray device as well as a separate rigid container with apertures through its walls positioned within the normal rigid container of the spray device for filling with water for dispensing the chemical from the flexible container.

Additional examples of the prior art are shown in U.S. Pat. No. 1,950,155 and U.S. Pat. No. 2,944,706.

SUMMARY OF THE INVENTION

The present invention relates to a refillable liquid dispenser or container comprising an outer rigid hollow housing including an externally threaded upper neck to receive a liquid dispensing assembly therethrough and a replaceable inner pliant liquid bladder disposed within the outer rigid hollow housing to receive the lower portion of the liquid dispensing assembly therein.

The outer rigid hollow housing includes an upper opening formed in the upper portion thereof to facilitate the installation or placement of the replaceable inner pliant liquid bladder therein and a lower opening formed in the bottom or base thereof to receive the replaceable inner pliant liquid bladder therethrough.

The replaceable inner pliant liquid bladder comprises an upper bladder portion that joins a lower bladder portion. An installation means may be coupled to the replaceable inner pliant liquid bladder to aid in the installation or placement of the replaceable inner pliant liquid bladder in the outer rigid hollow housing.

The replaceable inner pliant liquid bladder is placed through the lower opening into the interior of the outer rigid hollowing housing. The upper bladder portion and installation means may be grasped through the upper opening and guided through the externally threaded upper neck. The upper bladder portion is then pushed downward partially into the externally threaded upper neck. The edges are folded over the externally threaded upper neck and held against the externally threaded upper neck with the thumb and forefinger. The liquid dispensing assembly is forced through the bottom of the upper bladder portion into the replaceable inner pliant liquid bladder. An internally threaded cap is then secured to the externally threaded upper neck such that the replaceable inner pliant liquid bladder is held in place therebetween.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
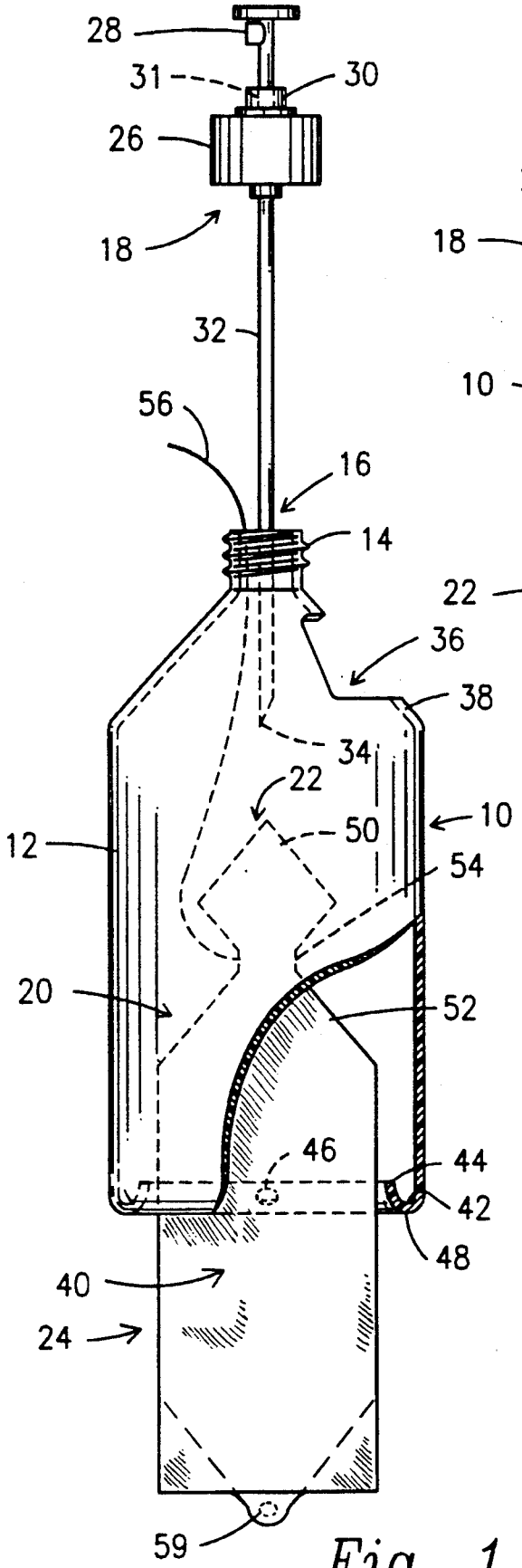
FIG. 1 is an exploded side view of the refillable liquid bladder.
Figure 2:
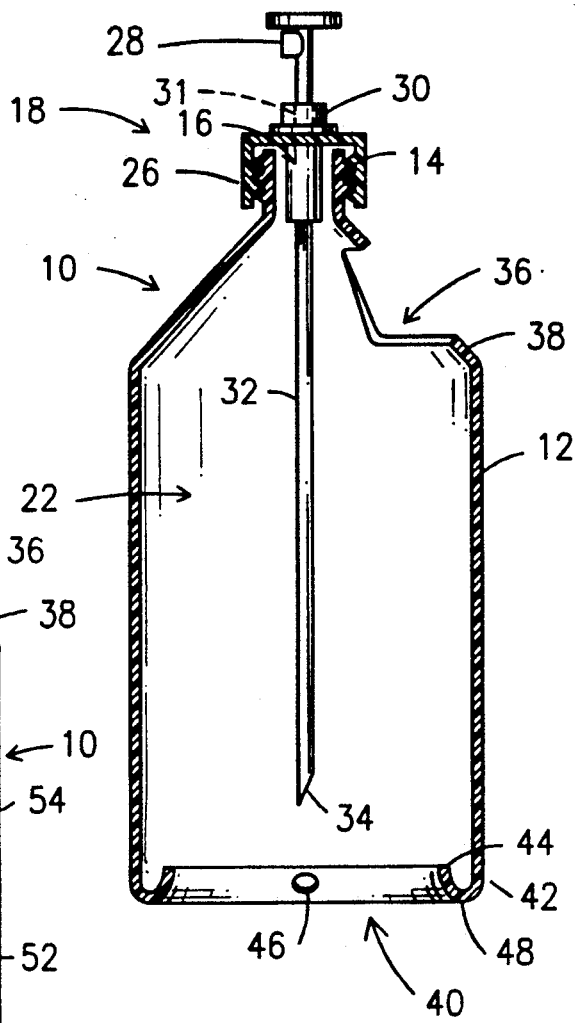
FIG. 2 is a cross-sectional side view of the outer rigid hollow housing.

As shown in FIGS. 1 and 2, the present invention relates to a refillable liquid dispenser or container generally indicated as 10 comprising an outer rigid hollow housing 12 including an externally threaded upper neck 14 having an opening 16 formed therein to receive a liquid dispensing assembly generally indicated as 18 therein and a replaceable inner pliant liquid bladder generally indicated as 20 including an upper bladder portion generally indicated as 22 disposed within the externally threaded upper neck 14 and a lower bladder portion generally indicated as 24 disposed within the outer rigid hollow housing 12 to receive the lower portion of the liquid dispensing assembly 18 therein.

As shown in FIGS. 1 and 2, the liquid dispensing assembly 18 comprises an internally threaded cap 26 to secure the liquid dispensing assembly 18 to externally threaded upper neck 14, a spray nozzle 26, a spray-pump cap 30 including an aperture 31 and a lower liquid dip or siphon tube 32 having an inclined or pointed distal end 34 to puncture the upper bladder portion 22 of the replaceable inner pliant liquid bladder 20 when installed or placed within the externally threaded neck 14 as described more fully hereinafter.

As shown in FIGS. 1 and 2, the outer rigid hollow housing 12 includes an upper opening 36 formed in the upper side wall 38 of the outer rigid hollow housing 12 to facilitate the installation or placement of the replaceable inner pliant liquid bladder 20 in the outer rigid hollow housing 12 as described more fully hereinafter and a lower opening 40 formed in the bottom or base 42 of the outer rigid hollow housing 12 to receive the replaceable inner pliant liquid bladder 20 therethrough. An inclined skirt 44 having a button or hook 46 formed thereon is formed around the periphery 48 of the lower opening 40.

Figure 3:
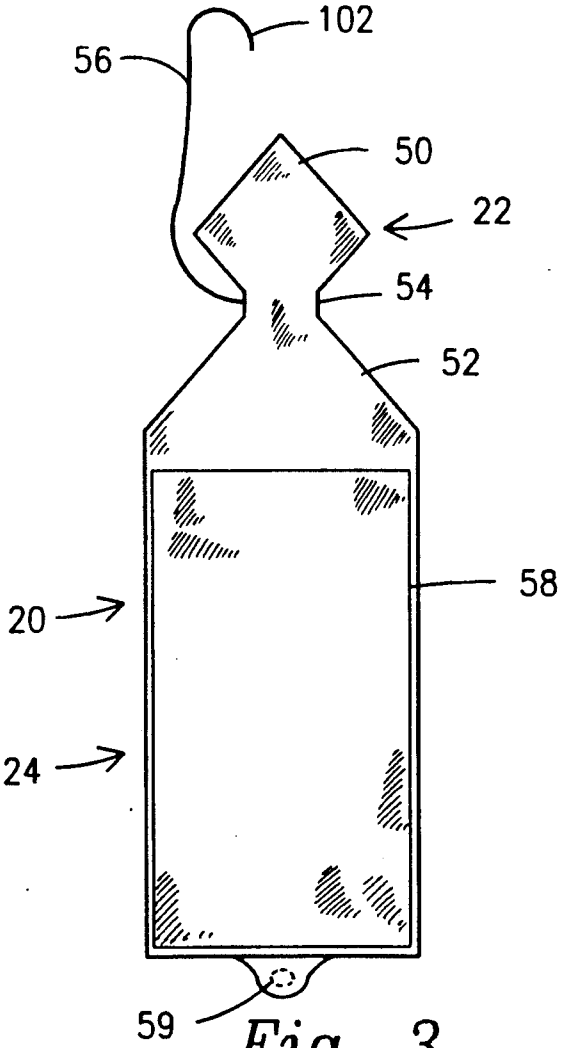
FIG. 3 is a side view of the replaceable inner pliant liquid bladder.

As best shown in FIG. 3, the upper bladder portion 22 of the replaceable inner pliant liquid bladder 20 comprises a flexible diamond shaped upper end 50 that intersects a reduced upper end 52 of the lower bladder portion 24 of the replaceable inner pliant liquid bladder 20 as at 54. An installation means such as a rigid member 56 (FIG. 3) or flexible element 57 (FIG. 4) may be coupled to the replaceable inner pliant liquid bladder 20 to aid in the installation or placement of the replaceable inner pliant liquid bladder 20 in the outer rigid hollow housing 12. A secondary bladder 58 to retain the liquid therein may be disposed within the replaceable inner pliant liquid bladder 20. An aperture 59 may be formed on the lower end of the lower bladder portion 24 to receive the button or hook 46 to retain the lower bladder portion 24 within the outer rigid hollowing housing 12 as the liquid is depleted from the replaceable inner pliant liquid bladder 20 or secondary bladder 58.

Figure 4:
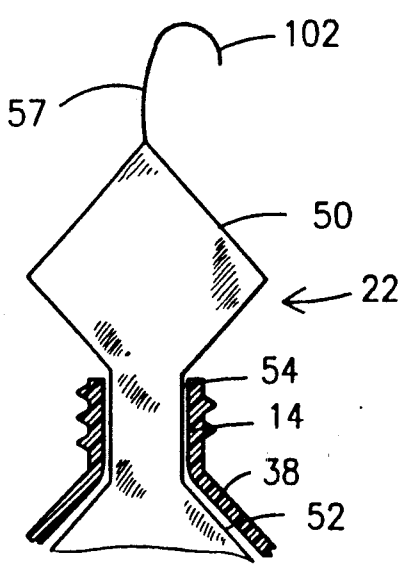
FIGS. 4 through 7 show partial side views of the replaceable inner pliant liquid bladder in various stages of installation in the outer rigid hollow housing.
Figure 5:
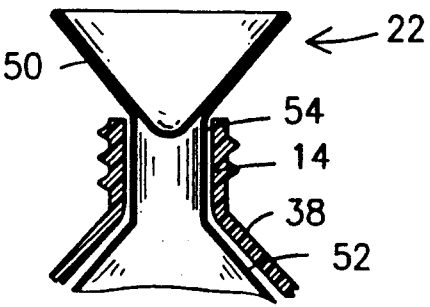
Figure 6:
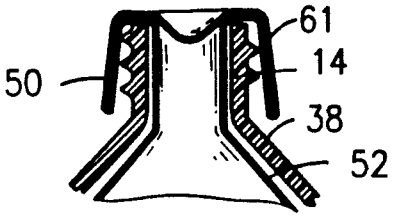
Figure 7:
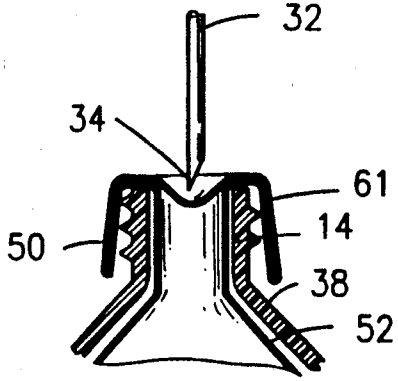

Installation or placement of the replaceable inner pliant liquid bladder 20 is best understood with reference to FIGS. 1 through 7. Specifically, the replaceable inner pliant liquid bladder 20 is placed through the lower opening 40 into the interior of the outer rigid hollowing housing 12. The upper bladder portion 22, rigid member 56 or flexible element 57 may be grasped through the upper opening 36 and guided through the opening 16 of the externally threaded upper neck 14 (FIG. 4). The upper bladder portion 22 is the pushed downwards partially into the opening 16 to form a funnel shaped configuration (FIG. 5). The edges 61 are folded over the externally threaded upper neck 14 and held against the externally threaded upper neck 14 with the thumb and forefinger. The inclined or pointed distal end 34 pierces the bottom of the funnel as the lower liquid dip or siphon tube 32 is moved downward into the replaceable inner pliant liquid bladder 20. The internally threaded cap 26 is then secured to the external threaded upper neck 14 such that the replaceable inner pliant liquid bladder 20 is held in place therebetween.

Figure 8:
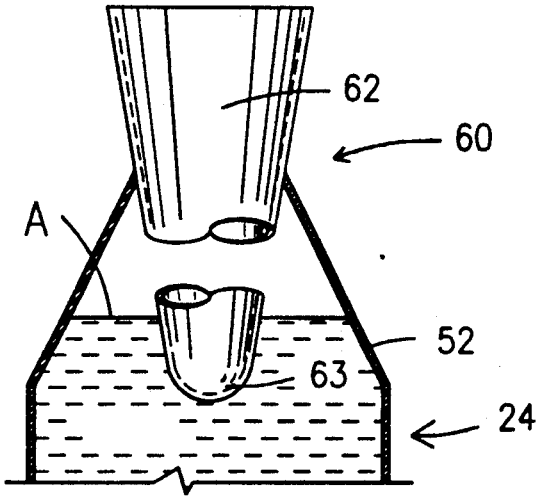
FIG. 8 is a partial side view of alternate embodiment of the replaceable inner pliant liquid bladder.

FIG. 8 shows an alternate embodiment of the replaceable inner pliant liquid bladder 20. Specifically, the upper bladder portion generally indicated as 60 of the replaceable inner pliant liquid bladder 20 comprises a flexible open funnel or cone-shaped upper end 62 extending into the reduced upper end 52 of the lower bladder portion 24 of the replaceable inner pliant liquid bladder 20. Installation or placement in the outer rigid hollowing housing 12 is similar to the procedure of the embodiment shown in FIGS. 4 through 7 except that the pressure created by the liquid A acts to seal the lower end 63 of the flexible open funnel or cone-shaped upper end 62 as the lower liquid dip or siphon tube 32 is forced therethrough.

Figure 9:
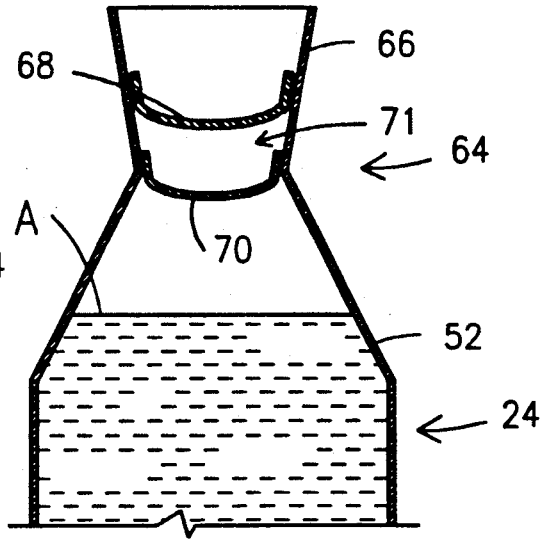
FIG. 9 is a partial side view of another alternate embodiment of the replaceable inner pliant liquid bladder.

FIG. 9 shows another alternate embodiment of the replaceable inner pliant liquid bladder 20. Specifically, the upper bladder portion 64 of the replaceable inner pliant liquid bladder 20 comprises a flexible upper end 66 including a first and second barrier indicated as 68 and 70 respectively cooperatively forming a liquid isolation chamber 71 therebetween that intersects the reduced upper portion 52 of the lower bladder portion 24 of the replaceable inner pliant liquid bladder 20. Installation or placement is similar to the procedure of the embodiment shown in FIGS. 4 through 7.

Figure 10:
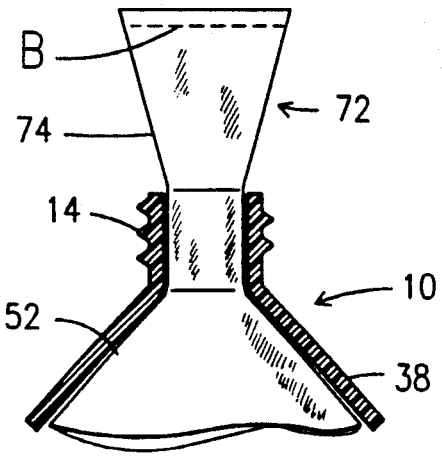
FIGS. 10 through 12 show yet another alternate embodiment of the replaceable inner pliant liquid bladder.
Figure 11:
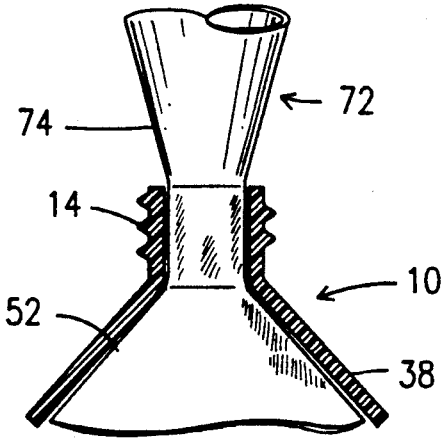
Figure 12:
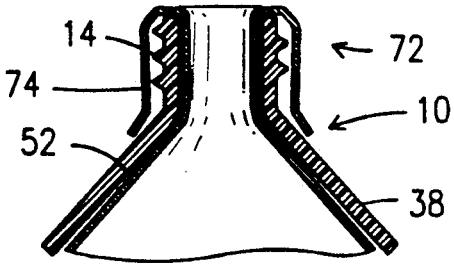

FIGS. 10 through 12 show yet another alternate embodiment of the replaceable inner pliant liquid bladder 20. Specifically, the upper bladder portion 72 of the replaceable inner pliant liquid bladder 20 comprises a flexible closed funnel shaped upper end 74 that intersects the reduced upper end 52 of the lower bladder portion 24 of the replaceable inner pliant liquid bladder 20. Installation or placement is similar to the procedure of the embodiment shown in FIGS. 4 through 7 except the top of the flexible closed funnel shaped upper end 74 is cut along line B.

Figure 13:
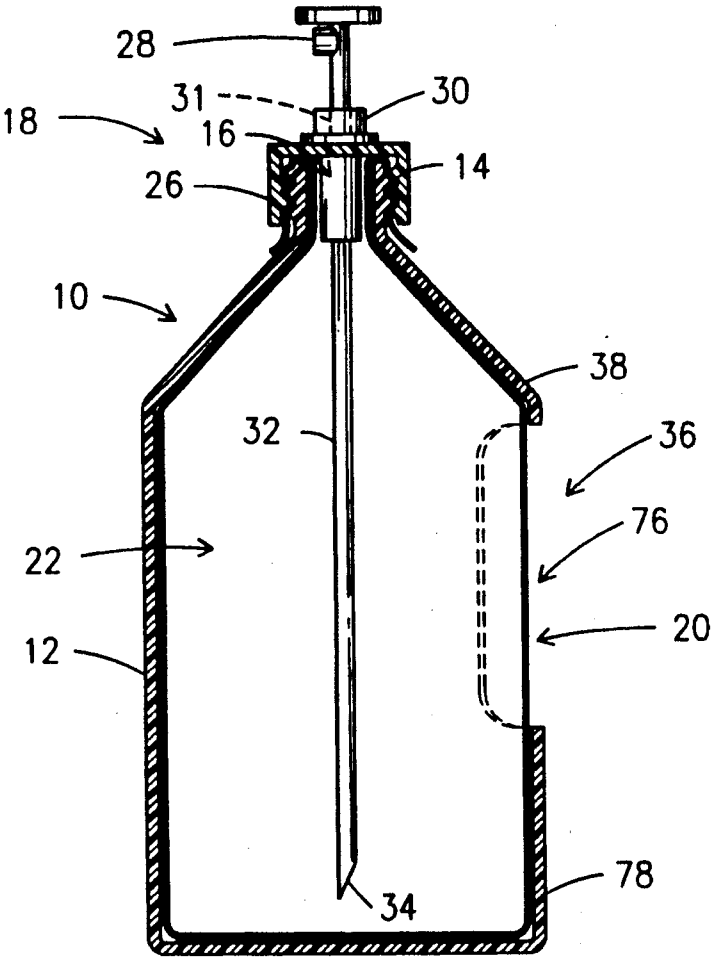
FIG. 13 is a cross-sectional side view of an alternate embodiment of the outer rigid hollow housing.

FIG. 13 shows an alternate embodiment of the outer rigid hollow housing 12 including a side opening 76 formed in the side wall 78 of the outer rigid hollow housing 12 to install or place the replaceable inner pliant liquid bladder 20 in the outer rigid hollow housing 12.

Figure 14:
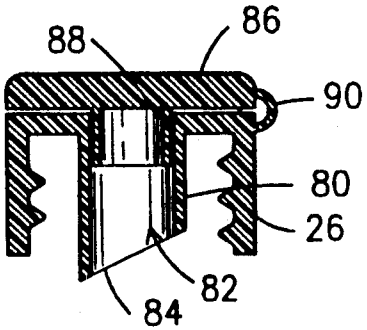
FIG. 14 is a cross-sectional side view of an alternate embodiment of the cap.
Figure 15:
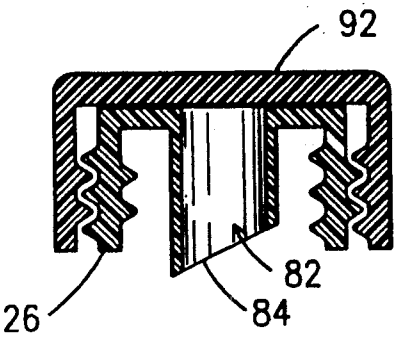
FIG. 15 is a cross-sectional side view of another alternate embodiment of the cap.

FIGS. 14 and 15 show alternate embodiments of the internally threaded cap 26. Specifically, as shown in FIG. 14, the internally threaded cap 26 further includes an inner concentrically aligned apron 80 forming a channel 82 having an inclined or distal end 84 formed thereon and a top 86 including a stopper 88 hingedly attached thereto by a hinge 90 to permit selective closure of the channel 82. The internally threaded cap 26 of FIG. 15 similarly includes the inner concentrically aligned apron 80 forming the channel 82 having the inclined or distal end 84 formed thereon. In addition, the outer surface of the internally threaded cap 26 is externally threaded to receive an internally threaded top 92 to permit selective closure of the channel 82.

Figure 18:
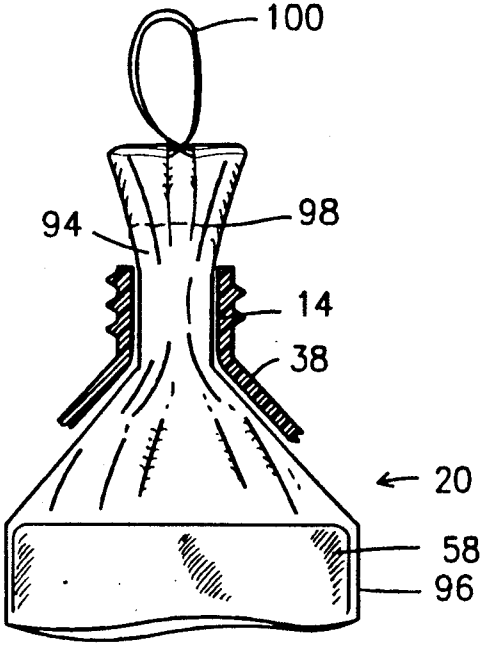
FIGS. 16 through 19 show still another alternate embodiment of the replaceable inner pliant liquid bladder.
Figure 19:
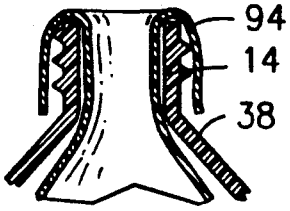
Figure 17:
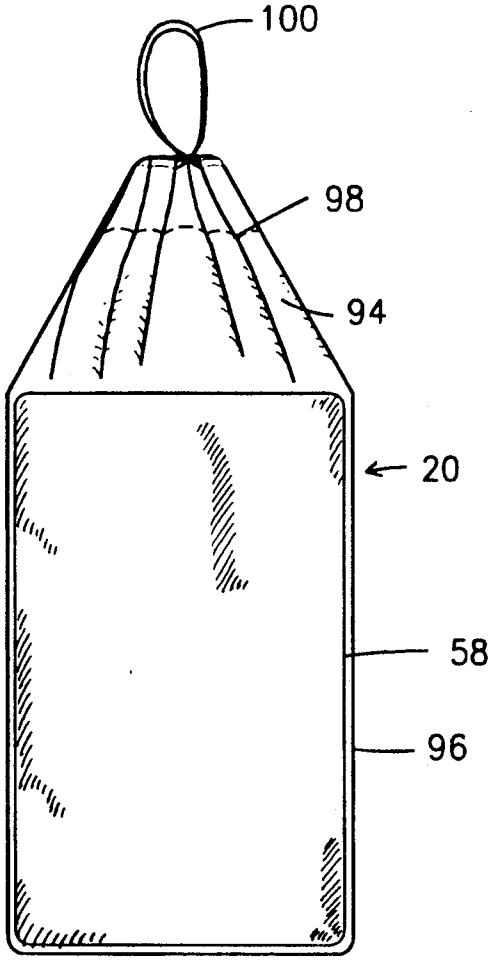
Figure 16:
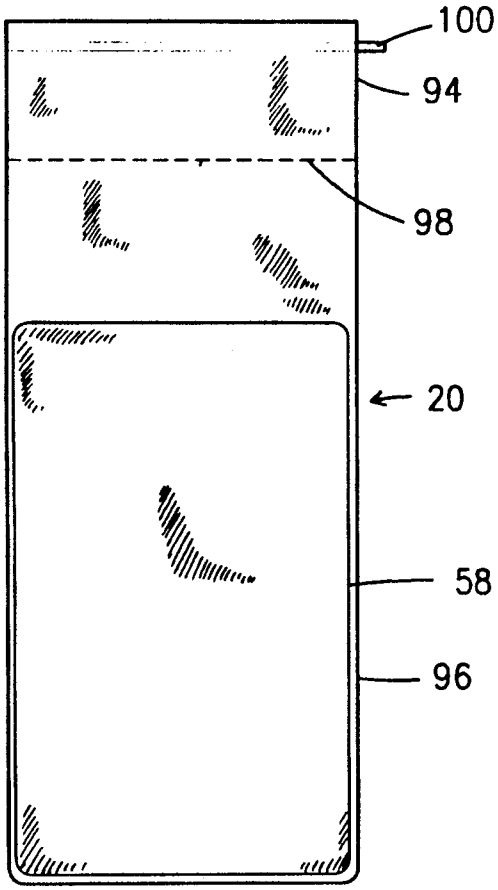

FIGS. 16 through 18 show still another alternate embodiment of the replaceable inner pliant liquid bladder 20. Specifically, the replaceable inner pliant liquid bladder 20 comprises a flexible rectilinear upper bladder portion 94 and a lower bladder portion 96 of the replaceable inner pliant liquid bladder 20 with the secondary bladder 58 disposed therein. Installation or placement is similar to the procedure of the embodiment shown in FIGS. 4 through 7 except the top of the flexible rectilinear bladder portion 94 is torn along a perforation line 98. An attachment means such as a draw string 100 may be attached to the flexible rectilinear upper bladder portion 94 to mount the replaceable inner pliant liquid bladder 20 for display. Alternately, the attachment means may comprise a hook 102 as shown in FIGS. 3 and 4. This hook 102 allows the purchaser to hang the replaceable inner pliant liquid bladder 20 on a grocery cart.

As shown in FIG. 1, the bottom of the replaceable inner pliant liquid bladder 20 may be substantially V-shaped.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A refillable liquid container comprising an outer rigid hollow housing including an upper neck having an opening formed therein, a cap to selectively seal said opening and a replaceable inner pliant liquid bladder including an upper bladder portion comprising a flexible diamond shaped upper end that intersects a reduced upper end of said lower bladder portion of said replaceable inner pliant liquid bladder disposed within said upper neck and a lower bladder portion disposed within said outer rigid hollow housing, said cap being secured to said upper neck such that said replaceable inner pliant liquid bladder is held in place therebetween.

2. The refillable liquid container of claim 1 wherein said outer rigid hollow housing further includes a lower opening formed in the bottom thereof to receive said replaceable inner pliant liquid bladder therethrough.

3. The refillable liquid container of claim 2 wherein said outer rigid hollow housing includes an upper opening formed in said outer rigid hollow housing to facilitate the installation and placement of said replaceable inner pliant liquid bladder in said outer rigid hollow housing.

4. The refillable liquid container of claim 2 wherein said outer rigid hollow housing further includes a skirt formed around the periphery of said lower opening.

5. The refillable liquid container of claim 1 wherein a first fastening means is formed on said outer rigid hollow housing and a second fastening means is formed on said replaceable inner pliant liquid bladder to engage said first fastening means to retain said lower bladder portion within said outer rigid hollow housing as the liquid is depleted from said replaceable inner pliant liquid bladder.

6. The refillable liquid container of claim 1 wherein said replaceable inner pliant liquid bladder further includes an installation means coupled thereto to facilitate the installation and placement of said replaceable inner pliant liquid bladder in said outer rigid hollow housing.

7. The refillable liquid container of claim 6 wherein said installation means comprises an elongated substantially rigid member coupled to said upper bladder portion.

8. The refillable liquid container of claim 6 wherein said installation means comprises an elongated flexible element coupled to said upper bladder portion.

9. The refillable liquid container of claim 6 further includes a secondary bladder to retain the liquid therein disposed within said replaceable inner pliant liquid bladder.

10. The refillable liquid container of claim 6 wherein said installation means further includes an attachment means to mount said replaceable inner pliant liquid bladder to a support before use.

11. The refillable liquid container of claim 1 further includes a secondary bladder to retain the liquid therein disposed within said replaceable inner pliant liquid bladder.

12. The refillable liquid container of claim 1 wherein said upper bladder portion of said replaceable inner pliant liquid bladder comprises a flexible upper end including a first and second barrier cooperatively forming a liquid isolation chamber therebetween.

13. The refillable liquid container of claim 1 wherein said outer rigid hollow housing includes a side opening formed therein to receive said replaceable inner pliant liquid bladder therethrough.

14. The refillable liquid container of claim 1 wherein said cap comprises an internally threaded cap and said upper neck comprises an externally threaded upper neck to operatively mate with said internally threaded cap.

15. The refillable liquid container of claim 14 wherein said internally threaded cap includes an inner concentrically aligned apron having a channel formed therethrough and a top including a stopper hingedly attached thereto by a hinge to permit selective closure of the channel.

16. The refillable liquid container of claim 15 wherein said inner concentrically aligned apron further includes an inclined distal end formed thereon to pierce said upper bladder portion.

17. The refillable liquid container of claim 14 wherein said internally threaded cap includes an inner concentrically aligned apron having a channel formed therethrough, said outer surface of said internally threaded cap being externally threaded to receive an internally threaded top to permit selective closure of said channel.

18. The refillable liquid container of claim 17 wherein said said inner concentrically aligned apron having said inclined distal end formed thereon to pierce said upper bladder portion.

19. The refillable liquid container of claim 1 further includes a liquid dispensing assembly comprises a cap to secure said liquid dispensing assembly to said upper neck, a spray nozzle, a spray-pump cap including an aperture and a lower liquid dip tube having an inclined distal end to puncture said upper bladder portion of said replaceable inner pliant liquid bladder when installed and placed within said upper neck.

20. The refillable liquid container of claim 1 wherein said replaceable inner pliant liquid bladder is perforated to permit separation of the upper end of said upper bladder portion from said lower bladder portion when installed in said outer rigid hollow housing.

21. The refillable liquid container of claim 1 further including an attachment means to mount said replaceable inner pliant liquid bladder to a support before use.

22. The refillable liquid container of claim 21 wherein said attachment means comprises a draw string coupled to said upper bladder portion.

23. The refillable liquid container of claim 21 wherein said attachment means comprises a hook coupled to said replaceable inner pliant liquid bladder.

24. The refillable liquid container of claim 1 wherein the bottom of said replaceable inner pliant liquid bladder is substantially V-shaped.

* * * * *